United States Patent [19]

Smith et al.

[11] Patent Number: 4,460,048

[45] Date of Patent: Jul. 17, 1984

[54] PUMP THROUGH EQUALIZING CHECK VALVE FOR USE IN INTERMITTENT GAS LIFT WELL

[75] Inventors: Everett H. Smith, Houston; Neil H. Akkerman, Kingwood, both of Tex.

[73] Assignee: Baker International Corporation, Orange, Calif.

[21] Appl. No.: 258,208

[22] Filed: Apr. 27, 1981 (Under 37 CFR 1.47)

[51] Int. Cl.[3] ..... E21B 33/00

[52] U.S. Cl. ..... 166/375; 166/373; 137/102

[58] Field of Search ..... 137/155, 102; 166/321, 166/375, 373

[56] References Cited

U.S. PATENT DOCUMENTS

| | | | |
|---|---|---|---|
| 3,034,527 | 5/1962 | Hennells | 137/102 |
| 3,070,112 | 12/1962 | Fricke | 137/102 |
| 3,385,370 | 5/1968 | Knox | 166/325 X |
| 3,554,281 | 1/1971 | Ecuer | 166/325 X |
| 3,603,394 | 9/1971 | Raulins | 166/325 X |
| 4,364,407 | 12/1982 | Hilliard | 166/325 X |

*Primary Examiner*—Alan Cohan
*Attorney, Agent, or Firm*—Norvell & Associates

[57] ABSTRACT

A valve apparatus for use in an intermittent gas lift subterranean well, having a reservoir with insufficient pressure for continuous delivery of produced fluids to the top surface of the well is disclosed. A valve apparatus carriable on a fluid transmission conduit has a flow passage for permitting produced fluids to flow through the transmission conduit from the reservoir. The valve is responsive to pressure to open the valve in the presence of a greater pressure exerted by the reservoir below the valve, and to close the valve in response to an even greater pressure generated by intermittent gas injection. A second flow passage selectively communicating with a radially extending port permits the flow of injected fluids from the tubing into the reservoir. A second valve, for selectively opening and closing the second flow passage, is spring biased in the closed position so that it remains closed when subjected to reservoir pressure, intermittent gas pressure, or their sum. The second valve is, however, opened in response to a greater pressure force due to an applied pressure including the pressure of injected fluids. The second valve comprises oppositely facing abutting shoulders, with one shoulder being biased into abutting relationship with the other shoulder for closing the port.

11 Claims, 10 Drawing Figures

PUMP THROUGH EQUALIZING CHECK VALVE FOR USE IN INTERMITTENT GAS LIFT WELL

BACKGROUND OF THE INVENTION

1. Field of the Invention

This invention relates to valves used in subterranean oil and gas producing wells which employ valves to regulate the flow of produced fluid and to regulate the injection of fluids used to treat the well.

2. Description of the Prior Art

It is not uncommon for the reservoir pressure in typical oil and gas producing wells to be insufficient to cause a produced fluid to flow naturally from the well. In such situations some means of artificially raising the produced fluid to the surface must be utilized. Even though the reservoir pressure may not be sufficient to raise a produced fluid to the surface it will normally be sufficient to support a column of fluid within the tubing. One method of artificially causing this column of produced fluid existing in the tubing to flow to the surface is to inject gas through the tubing wall at a point above the production zone but within the column of produced fluid. Gas may be injected continuously or intermittently depending upon the rate at which the produced fluid, under the action of the reservoir pressure, flows into the tubing. If the reservoir pressure is sufficient to maintain continuous flow into the tubing, continuous injection of gas will cause the produced fluid-gas mixture to continuously flow to the surface of the well. If the reservoir pressure is insufficient to cause the continuous flow of produced fluids from the formation through the casing perforations and into the tubing string, intermittent gas injection may be the only efficient method of gas lifting the fluid to the surface. Intermittent injection of high pressure gas into the tubing string will cause the fluid column, or slug, which has accumulated over some period of time, to be propelled to the surface almost as if the fluid constituted a cohesive mass.

For intermittent gas lift, some means must be provided to prevent the fluid from returning through the casing perforations and into the formation under the action of the injected gas. If the fluid and the injection gas is allowed to flow backward and return to the formation there will at least be a loss of efficiency in the intermittent gas lift process, and there could even be resulting damage to the formation. It is, therefore, quite common to employ a one-way acting check valve or standing valve on the lower portion of the tubing string to prevent the return of the produced fluid, or portions thereof, to the formation. Such a one-way acting check valve would allow the produced fluid to flow from the formation through the casing perforations and into the lower portion of the tubing string. However, the valve, under the action of injected gas, would close thereby, preventing any back flow. One valve which may be employed as a back check valve would be a one-way acting ball valve. As the fluid enters the tubing string under the action of the reservoir pressure, the ball would be lifted from its seat allowing the fluid to enter the tubing. When high pressure gas is injected above the back flow valve, the ball would be forced down onto its seat preventing any back flow. Such back flow valves are now commonly employed in intermittent gas lift oil well operations.

Back check valves currently used in intermittent gas lift wells are adequate to establish one-way flow of the produced fluid as long as there is no blockage of the valve or the tubing in the neighborhood of the formation. In some situations where intermittent gas lift wells are employed, there may be signficant problems with the buildup of contaminants. For example, the presence of dissolved salts in the produced fluid may lead to such contamination. In some instances these dissolved salts will precipitate out upon entering the well bore. These precipitated salts then act to restrict the flow of oil from the formation through the perforations and into the tubing. In general, these salts will constitute water soluble salts such as calcium chloride or certain potassium salts. After a period of time these precipitated salts must be cleared out in order to allow normal production and operation of the well. The common method of cleaning these salts out is to inject fresh water into the well bore so that these salts will be dissolved. The formation is, however, not accessible through the tubing-casing annulus because a packer will be employed to seal off the annulus above the producing zone. Fresh water must therefore be injected through the tubing string. However, this injected fresh water cannot pass through the back check valve which is seated by the hydrostatic pressure of the water column. Therefore, in order to clean out this salt formation it is now necessary either to retrieve the back check valve or to pull the tubing out of the well. Of course, this latter operation is quite expensive and needs to be avoided whenever possible. It may be difficult, however, to retrieve the back check valve from the tubing string using normal wire line techniques. The salt buildup may restrict the normal I.D. of the tubing string and interfere with access to the back check valve.

The preferred embodiment of the present invention comprises a valve which allows flow of oil or other produced fluids from the reservoir or formation into the tubing string under normal situations. The preferred embodiment of this valve also prevents back flow of the fluid into the formation under the action of normal intermittent gas flow pressures. Relief action is provided in this valve, however, so that the hydrostatic pressure created by fresh water injected to flush out the tubing string and formation will force the valve open allowing the water to enter the formation from the opposite direction.

SUMMARY OF THE INVENTION

This invention comprises a flow regulation mechanism which, although allowing flow in opposite directions, prevents flow in at least one direction only in the presence of specified pressures. This back check valve allows flow of oil or produced fluids in an oil well from the formation to an oil well tubing string under the action of the reservoir pressure. The ball, however, returns to its seat under the action of injected gas pressure from above the valve. Produced fluids flow through the central bore of the main body of the valve between the ball and its seat and along longitudinal channels surrounding the ball. Injected pressure above the valve will, however, force the ball downward onto its seat preventing flow through the central bore of the valve. A force substantially greater than that resulting from intermittent gas pressure will, however, force both the ball and its seat to move against the action of a biasing spring, thereby opening a radially extending port and permitting flow between the ball and its seat and the exterior of the valve.

DESCRIPTION OF THE PREFERRED EMBODIMENTS

Figure 1:
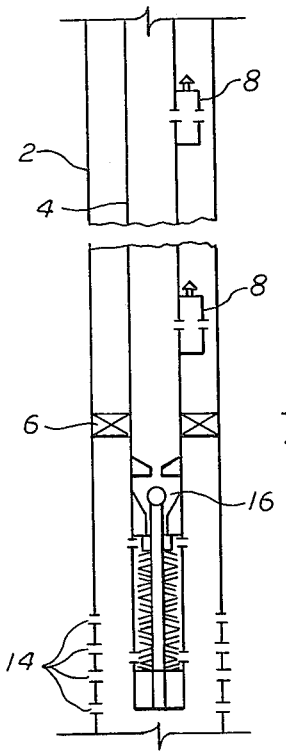
FIG. 1 is a schematic view of an oil well completion employing intermittent gas lift.
Figure 2:
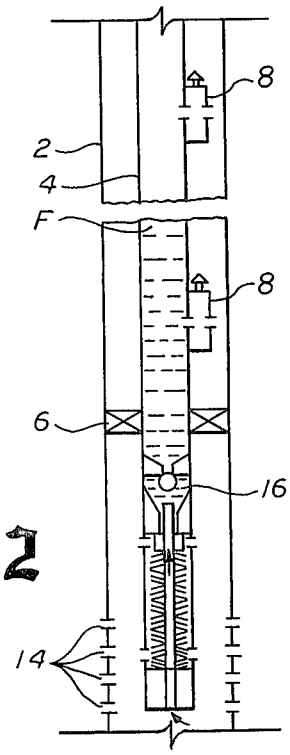
FIG. 2 is a schematic view similar to FIG. 1 but showing the oil flowing through the back check valve and forming a fluid slug within the tubing string.
Figure 3:
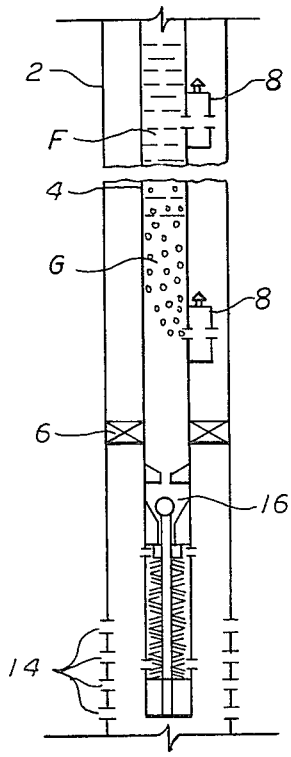
FIG. 3 is a schematic view similar to FIGS. 1 and 2 but showing the injection of gas into the tubing string through a gas lift valve and showing the manner in which the fluid slug is propelled upward to the surface of the tubing string.
Figure 4:
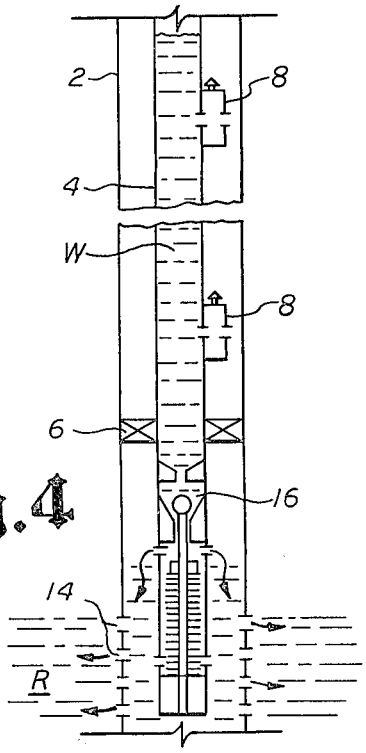
FIG. 4 is another schematic view showing the injection of water through the tubing string and into the formation to flush contaminating salts.
Figure 5:
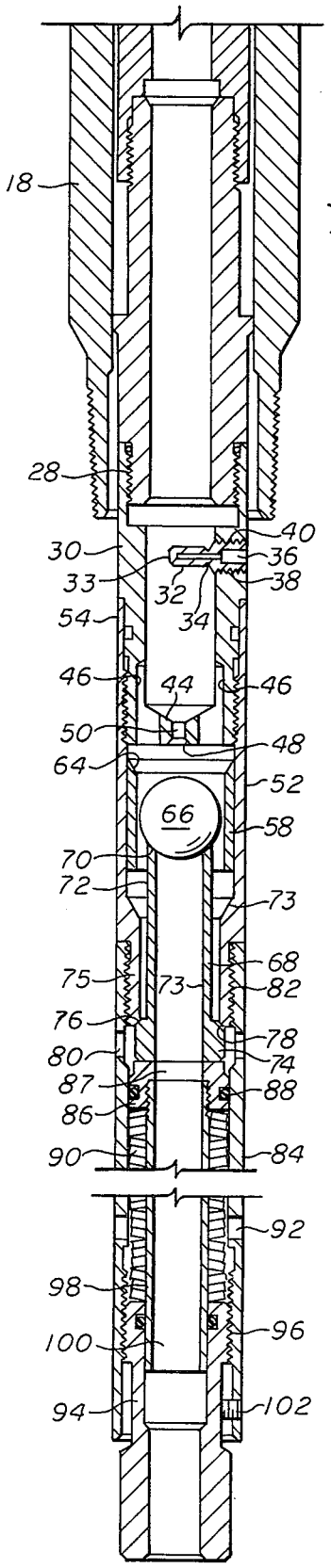
FIG. 5 is a longitudinal view showing the ball seated under the action of pressure from above the valve.

The operation of an intermittent gas lift well employing a check valve with integral bypass relief such as the valve represented by the preferred embodiment of this invention is schematically depicted in FIGS. 1 through 4. An intermittent gas lift well as shown in these schematic Figures comprises a casing 2 through which a tubing string 4 extends. The tubing string or fluid transmission conduit 4 and the casing 2 are separated by a conventional packer 6, here shown adjacent to the bottom of the tubing string. The packer 6 serves to seal the tubing casing annulus and to isolate the upper portion of the tubing casing annulus from the producing zone, formation, or reservoir R. The oil or other produced fluid enters the tubing through perforations 14 conventionally employed for this purpose. The produced fluids F cannot flow through the casing beyond the packer and must therefore enter the lower portion of the tubing string 4. A check valve, back flow valve, or standing valve 16 is attached to the lower end of tubing string 4. Under the action of pressure from reservoir R, oil or produced fluids will enter the bottom of valve 16 and will eventually form a column of fluid within the tubing string, as shown in FIG. 2. One or more gas lift valves 8 of conventional design is shown on the exterior of tubing 4 in the tubing casing annulus. This gas lift valve is positioned above the conventional packer and allows the periodic injection of high pressure gas into the tubing string below the upper surface of the fluid column. As shown in FIG. 3, the fluid column is propelled upward and rises to the surface. Injection of fluid pressure through one or more gas lift valves also causes the ball 66 and valve 16 to close below a portion of the tubing string preventing any flow of the fluid column back into the formation. FIG. 4 illustrates the manner in which fresh water plus some other fluids may be injected into the tubing string to cause valve 16 to open permitting the water, W, or other fluids to enter the formation to flush out contaminates.

Valve 16 may be attached to a tubing string 4 by the use of a conventional nipple 18. This nipple 18 threadably engages the lower end of the tubing string. Nipple 18 has a conventional inner annular recess 20 extending circumferentially around the inner bore of the nipple. A conventional lock 22 can be employed to attach valve 16 to nipple 18 and in turn tubing string 4. Lock 22 employs a conventional lock ear 24 which under the action of a spring 26 can be forced outwardly into recess 20. The lock and tubing string are therefore held in position with respect to nipple 18. Lock 22 is attached to valve 16 by means of a threaded connection 28 at its lower end.

Figure 8:
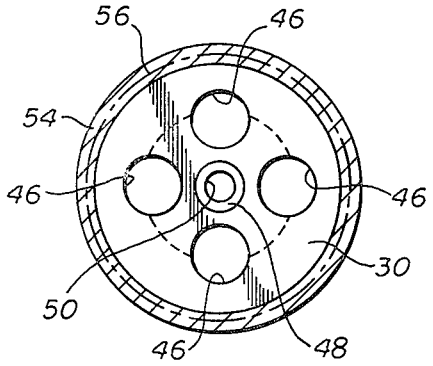
FIG. 8 is a cross-sectional view taken along section 8—8.
Figure 10:
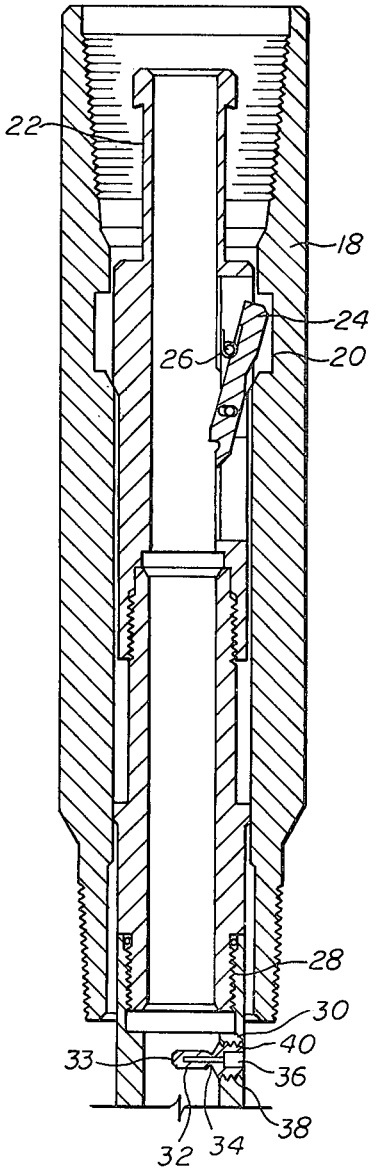
FIG. 10 is a view showing the nipple and lock used to attach the valve to the tubing.

Valve 16 comprises a cylindrical housing 30 at its upper end. Housing 30 has suitable threaded connections 28 for engaging a lock 22 or other assembly thereabove. Adjacent to the upper portion of housing 30 is a radially extending threaded hole 40. An equalizing tit or projection 32 is mounted in hole 40 by means of threaded connections 38. Equalizing projection 32 extends through hole 40 and into the central cylindrical bore 42 of valve 16. Projection 32 has a cylindrical finger 33 at its innermost end with a weakened section or circumferential groove 34 located at the base of finger 33 between finger 33 and base 38. This weakened section 34 defines the point at which the equalizing projection 32 would fail when subjected to transverse loading. An inner equalizing port 36 extends from the exterior of equalizing tit 32 past weakened section 34 and into finger 33. The central upper cylindrical bore or central fluid passageway 42 of upper housing 30 extends from its upper end partially through housing 30. Conical surface 64 at the base of concentric bore 42 is formed upon completion of the drilling operation. A plurality of axial tubular passages 46 extend upward from the base of upper housing 30 past the lower terminus of central cylindrical bore 42. Each lower tubular passage 46 communicates with cylindrical bore 42, thus permitting flow along the entire length of upper housing 30. As seen in FIG. 8, four tubular passages are employed in this embodiment of the invention, although a different number of passages could be employed without departing from the spirit of this invention. A small conical surface 48 is formed along the lower portion of upper housing 30 and is centrally located communicating with bore 42. This cylindrical conical surface is centrally positioned with respect to upperly extending tubular passages 46.

The main body 52 of valve 16 engages upper housing 30 by means of threaded connections 56 located on the exterior of housing 30 and the interior of main body 52. Main body 52 comprises an upperly extending cylindrical sleeve 54 at its uppermost end with threaded connections 56 being located on the interior of upper sleeve 54. Main body 52 comprises a generally cylindrical member having a cylindrical bore extending completely therethrough. This cylindrical bore has an inner diameter larger than the inner diameter of central fluid passageway 42. When main body member 52 is threadably engaged with upper housing 30, an enlarged internal cavity is formed in body member 52. A plurality of longitudinal ribs 58 extend from the outer sleeve of main body 52 into the bore extending through main body 52. Each rib terminates in a generally concave surface 59 at its innermost end. Each rib 58 has radially extending walls 62 which define longitudinal channels 60 communicating with and extending parallel to the central bore of main body 52. A spherical member or ball element 66 is located within the central bore of main body 52 and is centralized by means of concave surfaces 59. Ribs 58 and surfaces 59 comprise alignment means acting to keep ball 66 aligned with the central passageways. Ball 66 is, however, free to move longitudinally and neither ribs 58 nor concave surfaces 59 restrict that movement. Ball 66 is free to move axially along ribs 58 until ball 66 abuts the conical surface 48 located at the lower end of upper housing 30. At any point along the axial travel of ball 66, unrestricted flow passages are provided by channels 60. Recessed threaded connections 82 are located around the periphery of main body 52 adjacent its lowermost end. The lower portion 75 of main body 52 has a reduced inner diameter. A beveled surface 73 extends between lower main body section 75 and upper sleeve 54. A beveled surface 78 is located at the lowermost end of main body 52. This beveled surface comprises a lower shoulder.

An elongated cylindrical ball seat 68 is positioned within the bore of main body housing 52 and extends along the entire length of the lower portion 75 of the main body having a reduced inner diameter. Ball seat 68 comprises a cylindrical sleeve portion 72 and an enlarged base or collar 74. The inner surface 73 of ball seat 68 is centrally located and defines a central flow passageway, and is of substantially the same diameter as the central bore extending from the upper portion of housing 30. A ball seat surface 70 is located at the upper end of the ball seat sleeve 72. Ball seat base 74 extends radially outward from the exterior of sleeve 68. A beveled surface 76 is located along the upper edge of circumferential base member 74. When ball seat 68 is inserted into the main housing 52 beveled surface 76 on the seat abuts the lowermost beveled surface 78 on housing 52 to form a metal-to-metal seal.

A cylindrical spring housing sleeve 84 is attached to the lower end of main body 52. This cylindrical sleeve forms a threaded connection at its uppermost end with main body 52. Immediately below threaded connection 82 a radial port extends through cylindrical sleeve 84. A spring retaining collar 86 is located within sleeve 84 at its upper end, and when spring sleeve 84 is mated with main body 52 this upper spring retaining collar 86 abuts the lower surface of the enlarged base 74 on ball valve seat 68. Spring retaining collar 86 has a hole 87 extending therethrough in line with the bore 73 of ball seat 68. Collar 86 also has an annular ring extension in line with a stack of Belleville washers 90 contained within spring housing sleeve 84. An inner spring retaining sleeve 98 is threadably engaged with spring retaining collar 86 and the Belleville washer stack 90 is located in the annular space between sleeves 98 and 84. A threaded base member 94 engages threaded connections 96 on outer sleeve 84 to enclose Belleville washers 90 in the space between sleeves 84 and 98 and base 94 and collar 86. Base member 94 moves axially along threaded connections 96 to define the height of the Belleville washer stack, thereby establishing the spring force exerted by Belleville washers 90. A set screw engaging both outer sleeve 84 and base member 94 locks base member 94 in place once suitable spring loads have been applied. A lower radial port 92 extends through sleeve 84 in the vicinity of the Belleville washer stack 90 to provide communication between the Belleville washers and the exterior of the valve 16. Inner spring retaining sleeve 98 also has a central bore 100 which comprises a lower central fluid passageway aligned with similar central passageways defined in the valve seat 68 and the upper housing 30.

OPERATION

Figure 6:
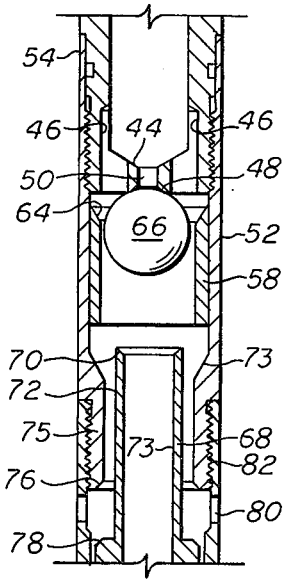
FIG. 6 is a view showing the ball floating free of its seat as fluid flows from below.
Figure 7:
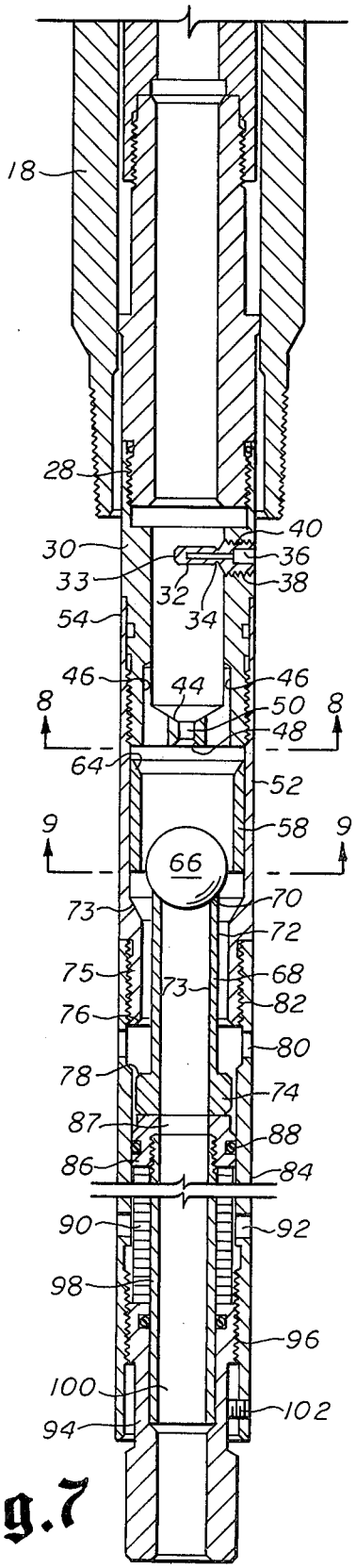
FIG. 7 is a view showing the relief action of the valve under pressure exerted from above.

As depicted in FIGS. 1 through 4, a back check valve, in accordance with the preferred embodiments of this invention, permits the flow of produced fluids upwardly into the tubing string but prevents the return of this produced fluid to the reservoir R under the action of intermittent gas lift pressure. FIG. 6 illustrates the position of ball 66 as produced fluids flow from the reservoir through valve 16 into tubing string 4. Note the ball 66 floats free of ball seat 68 permitting flow through the lower bore 100 defined by inner spring retaining sleeve 98, then upwardly through the ball seat bore 73 past ball 66 as fluid flows through channels 60. As the fluid flows through channels 60 it is then free to pass through any of a plurality of tubular passages 46 located in upper housing 30 and thence into central bore 42. Fluid then flows through the lock and nipple and into the main tubing string 4.

After a suitable fluid column F has risen into the tubing string, the gas lift valve 8 is activated to permit gas pressure to force the produced fluids F to the surface of the well. Opening of the gas lift valve, with its associated overpressuring of the tubing string, forces ball 66 down along concave surfaces 59 into engagement with conical ball seat surface 70. Flow through the aligned cylindrical bores and through channel 60 is therefore impossible. Neither can the fluid F flow through the annular space between ball seat 68 and the lower portion 75 of main body 52. The abutting shoulders 76 and 78 on ball seat 68 and main body 52, respectively, provide a metal-to-metal surface or sealing means closing radially extending port 80. Ball seat 68 is forced upwardly by the action of Belleville washers 90 which maintain the metal seal formed by beveled surfaces 76 and 78. The position of the back flow valve during the gas lift cycle is depicted by FIG. 6.

Figure 9:
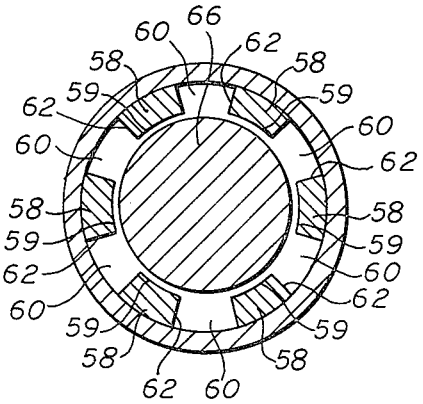
FIG. 9 is a cross-sectional view taken along section 9—9.

When it becomes necessary to flush out salts contaminating the formation and a portion of the tubing in the vicinity of valve 16, water is injected into the tubing string 4 from the surface. This operation is shown schematically in FIG. 4. Under the action of hydrostatic pressure exerted by the column of water inserted into the tubing, in addition to any surface pump pressure which may also be applied, the force exerted by Belleville washer stack 90 is overcome. This hydrostatic pressure forces ball 66 and ball seat 68 downwardly against the action of bevel washers 90. The metal-to-metal seal previously formed by beveled surfaces 76 and 78 is opened and a flow passage allowing the water to flow past ball 66 and through the radially extending port 80 is provided. When the valve, which functions as a relief valve and acts as a poppet valve, is in the position shown in FIG. 8, water may flow through channels 60, shown in FIG. 9, past ball 66 through the annular space between ball seat sleeve 70 and lower main body section 75 to radially extending port 80. This fresh water is then free to dissolve contaminating salt previously precipitated in the formation below packer 6. After these salts are dissolved the water can then move under the action of reservoir pressure up through the cylindrical aligned bores and this water may be removed from the tubing in the same or similar manner in which produced fluids were formerly ejected from the tubing string. The well is then free to return to normal operation and the cost of the retrieval of conventional check valves or the tubing itself has been avoided. The valve comprising the preferred embodiment of this invention permits flow in opposite directions in response to pressures of different magnitudes exerted both below and above the valve. Note that flow induced by the action of a greater pressure below ball 66 generally flows along the inner cylindrical bore throughout the entire length of valve 16. Flow induced by pressure from above, which will be of a sufficiently greater magnitude, flows along the cylindrical portion of the valve only above ball 66. Flow from above then proceeds along the annulus between ball seat 68 and main body section 75, and thence radially outward through port 80. Port 80 and ball 66 are longitudinally spaced apart to provide adequate area for metal-to-metal seals in the vicinity of port 80 and for longitudinally extending flow channels around ball 66 along the entire length of the intended travel of ball 66.

Valve apparatus 16 may be removed from the well by inserting a suitable tool to break equalizing projection 32 along weakened section 34 and to depress locking ear 24. The valve apparatus is then free from tubing string 4 and pressure equalization is provided through equalizing port 40.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve apparatus carriable on a fluid transmission conduit, for use in a subterranean well employing the intermittent introduction of a gas for the purpose of lifting the produced fluid to the well surface, for allowing the flow of produced fluids from a reservoir into said fluid transmission conduit and thereafter to the well surface, and for allowing injected fluids to flow from said fluid transmission conduit into the reservoir, said valve apparatus comprising: an outer cylindrical body; upper and lower aligned axially extending central fluid passageways for allowing flow of produced fluids therethrough; a cylindrical valve seat positioned between said upper and lower central fluid passage ways, said cylindrical valve seat having a central flow passageway axially aligned with said upper and lower central fluid passageways; spherical means axially movable between said upper central fluid passageway and said cylindrical valve seat for closing said central flow passageway in said cylindrical valve seat when subjected to a greater pressure from above than from below said spherical means; a plurality of axially extending fluid passageways communicating with said central fluid passageways and disposed about a centrally disposed conical surface, said spherical means engaging said centrally disposed conical surface when subjected to a greater pressure below than above said spherical means, whereby fluid communication through said axially extending fluid passageway and said central fluid passageways, a port extending through said outer cylindrical body immediate said cylindrical valve seat for allowing the flow of injected fluids therethrough; sealing means between said cylindrical valve seat and said outer cylindrical body, for sealing said port; and biasing means for exerting a force acting on said cylindrical valve seat to seal said portion the presence of a resultant pressure force above said spherical means which is less than the force exerted by said biasing means.

2. The apparatus of claim 1 wherein said sealing means comprises a downwardly facing shoulder on the interior of said outer cylindrical body and an upwardly facing shoulder on the exterior of said cylindrical valve seat, said upwardly facing shoulder being movable relatively into abutment with said downwardly facing shoulder to establish a metal-to-metal seal.

3. The apparatus of claim 1 wherein said cylindrical valve seat means and said spherical means are positioned within an internal cylindrical chamber defined by the inner surface of said outer cylindrical body, said internal cylindrical chamber having an inner diameter greater than the inner diameter of said central fluid passageways.

4. The apparatus of claim 3 wherein alignment means extend radially inward into said internal cylindrical chamber to hold said spherical ball means in alignment with said central fluid passageways and cylindrical valve seat.

5. The apparatus of claim 4 wherein said alignment means comprise a plurality of rib members extending radially inwardly from said outer cylindrical body, said rib members being spaced apart to define axial flow channel means between adjacent rib members to allow fluid to flow around said spherical ball means through said channel means.

6. The apparatus of claim 1 wherein said cylindrical valve seat has first and second axially spaced apart ends, the outer diameter of said second end immediate said port being greater than the outer diameter of said first end.

7. The apparatus of claim 6 wherein a surface on said first end defines means to engage said spherical ball means to close said central flow passageway in said cylindrical valve seat.

8. The apparatus of claim 6 wherein the exterior of said cylindrical valve seat and the interior of said outer cylindrical housing define an annular flow passageway extending concentrically with said central fluid passageway in said cylindrical valve seat.

9. The apparatus of claim 8 wherein said second end of said cylindrical valve seat is relatively movable under the action of said biasing means into abutting relationship with a downwardly facing shoulder on said outer cylindrical body to establish sealing integrity between said annular flow passageway and said port.

10. A valve apparatus carriable on a fluid transmission conduit for use in a subterranean well in which the fluid transmission conduit is intermittently subjected to differing pressures, said valve allowing the flow of produced fluids from a reservoir therethrough and subsequently to the surface of the well and for allowing fluids injected from the surface of the well to flow through said fluid transmission conduit past said valve apparatus, said valve apparatus comprising: a cylindrical body, upper and lower aligned axially extending central fluid passageways for allowing flow of produced fluids therethrough; a cylindrical valve seat positioned between said upper and lower central fluid passageways, said cylindrical valve seat having a central flow passageway axially aligned with said upper and lower central fluid passageways; spherical means axially movable between said upper central fluid passageway and said cylindrical valve seat for closing said central flow passageway in said cylindrical valve seat when subjected to a greater pressure from above than from below said spherical means; a plurality of axially extending fluid passageways communicating with said upper and lower central fluid passageways and disposed about a centrally disposed conical surface, said spherical means engaging said centrally disposed conical surface when subjected to a greater pressure below than above said spherical means, whereby fluid communication through said axially extending fluid passageways and said upper and lower central fluid passageways, a port extending through said outer cylindrical body immediate said cylindrical valve seat for allowing the flow of injected fluids therethrough; sealing means between said cylindrical valve seat and said cylindrical body, for sealing said port; and biasing means for exerting a force acting on said cylindrical valve seat to seal said port in the presence of a resultant pressure force above said spherical means which is less than the force exerted by said biasing means.

11. A valve apparatus carriable on a fluid transmission conduit in which the fluid transmission conduit is intermittently subjected to differing pressures, said valve allowing the flow of fluids therethrough in a first direction and for allowing fluids injected in a second direction through said fluid transmission conduit past said valve apparatus, said valve apparatus comprising: a cylindrical body, upper and lower aligned axially extending central fluid passageways for allowing flow of produced fluids therethrough; a cylindrical valve seat positioned between said upper and lower central fluid passageways, said cylindrical valve seat having a central flow passageway axially aligned with said upper and lower central fluid passageways; spherical means axially movable between said upper central fluid passageway and said cylindrical valve seat for closing said central flow passageway in said cylindrical valve seat when subjected to a greater pressure from above than from below said spherical means; a plurality of axially extending fluid passageways communicating with said upper and lower central fluid passageways and disposed about a centrally disposed conical surface, said spherical means engaging said centrally disposed conical surface when subjected to a greater pressure below than above said spherical means, whereby fluid communication through said axially extending fluid passageways and said upper and lower central fluid passageways, a port extending through said outer cylindrical body immediate said cylindrical valve seat for allowing the flow of injected fluids therethrough; sealing means between said cylindrical valve seat and said cylindrical body, for sealing said port; and biasing means for exerting a force acting on said cylindrical valve seat to seal said port in the presence of a resultant pressure force above said spherical means which is less than the force exerted by said biasing means.

* * * * *